US005279052A

United States Patent [19]

Perotto et al.

[11] Patent Number: 5,279,052

[45] Date of Patent: Jan. 18, 1994

[54] SKI BOOT SHELL WITH INVERTED FLAPS

[75] Inventors: Riccardo Perotto; Renzo Balbinot; Valentina Zanini, all of Treviso, Italy

[73] Assignee: Skis Rossignol S.A., France

[21] Appl. No.: 32,048

[22] Filed: Mar. 16, 1993

[30] Foreign Application Priority Data

Feb. 20, 1991 [FR] France ..... 91 02241
Feb. 18, 1992 [FR] France ..... 92420052

[51] Int. Cl.[5] ..... A43B 5/04
[52] U.S. Cl. ..... 36/50.5; 36/117
[58] Field of Search ..... 36/117, 118, 119, 120, 36/121, 56.1, 50.5

[56] References Cited

U.S. PATENT DOCUMENTS 3,545,106 12/1970 Martin ..... 36/50.5
4,841,650 6/1989 Dodge et al. ..... 36/119
5,003,710 4/1991 Pozzobon ..... 36/117
5,054,214 10/1991 Sartor ..... 36/117

FOREIGN PATENT DOCUMENTS 0304404 2/1989 European Pat. Off. ..... 36/117
1915442 10/1970 Fed. Rep. of Germany .
2024046 12/1970 Fed. Rep. of Germany .
1511824 2/1968 France .

*Primary Examiner*—Paul T. Sewell
*Assistant Examiner*—Marie Denise Patterson
*Attorney, Agent, or Firm*—Parkhurst, Wendel & Rossi

[57] ABSTRACT

Ski boot made of plastic material consisting of:

a deformable shell having two tongues which overlap to form flaps over the top of the foot;

a cuff with a hinge on the shell shaped to form, at the front, two straps forming flaps over the front of the lower part of the leg;

closing devices intended to slide the flaps over each other and thereby secure the foot in the shell and the lower part of the leg in the cuff;

wherein the flap of the shell which corresponds to the outside edges of the foot covers the flap of the inside edge of the foot, whereas the flap which corresponds to the inside edge of the cuff covers the flap of the outside edge of the cuff.

5 Claims, 3 Drawing Sheets

SKI BOOT SHELL WITH INVERTED FLAPS

BACKGROUND OF THE INVENTION

1. Field of the Invention

The present invention relates to a ski boot made of man-made material, the lower part of which consists of a shell surrounding the foot and the heel and the upper part of which consists, in a known fashion, of a cuff with a hinge on the shell, open at the front and surrounding the lower part of the leg.

2. Description of the Prior Art

It is the foot in a ski boot, in particular its inside edge, which controls the movement of the skis via the shell. It is therefore very important for the shell to mould to the shape of the foot, especially its inside edge, as far as possible, as this determines the precision of the movement of the skis.

Given the morphological differences of the foot conditioned by individual factors (height of the person, shoe size, gender etc.) or ethnic ones (differences between the feet of Japanese, Americans and Europeans), it is essential for the shell to have a system of adjustment for its inside volume in order to adapt to these anatomical differences.

Prior Art efforts to solve these problems have led to the creation of several types of boots.

The first type is so-called flap boots commonly called "overlapped boots" or "front entry boots". These boots use a semi-rigid shell with a slot on the top, forming two overlapping tongues or flaps allowing the foot to be inserted. By definition and in the remainder of the text, the term inside flap shall refer to the flap corresponding to the inner or inside edge of the foot and outside flap shall refer to the flap corresponding to the outer or outside edge of the foot. In these boots, when the boot is fastened with the aid of a buckle or other means, the inside flap of the shell covers the outside flap. In a known fashion, the shell with flaps is joined to a cuff with a hinge which also has overlapping flaps. In the boots illustrated for example in FR-A-1 511 824 or DE-A-2 024 046, the flaps of the shell and the flaps of the cuff overlap and are placed all on the same side, i.e. the inside flap over the outside flap so that the inside flap is on top and towards the outside.

The advantage of this system is the ability of the shell to be deformed due to the effect of the buckles allowing it to adapt to the shape and size of the foot, while ensuring that fastening pressure is evenly distributed over the foot. However, in this design, the inside flap of the shell when it covers the outside flap gradually loses contact with the inside edge of the foot as it comes closer to the top. Furthermore, in this case, the end of the lever of the buckle is positioned on the outside edge of the foot, near the sole, which could cause the skier to fall when it comes into contact with the snow when the skier puts his weight on the edge of the ski.

DE-A-1915 442 discloses a ski boot consisting of a rigid plastic shell to which a leather upper is added. In this supple unhinged upper, each flap on the top of the foot is connected by a supple membrane to the corresponding flap on the lower part of the leg. If, in an illustrated embodiment, the outside flap can cover the inside flap on the top of the foot, this necessarily means that the corresponding flaps on the lower part of the leg also overlap in the same direction. This positioning has the disadvantage of requiring buckles to be placed on the inside edge of the boot, which would be a hindrance when skiing to say the least. This certainly explains why boots of this type have never been marketed.

The second type is boots with a tongue. These make use of a shell which is wide open on the top of the foot to make fitting easy. This opening is covered by a forward-hinged tongue, ensuring both that the boot is watertight and that the side joints come closer due to the effect of the buckles by virtue of the wedge effect. Such a process is described in particular in FR-A-2 371 896 of the Applicant. This technique has the advantage for the user of making the boot easy to put on and take off by pivoting the tongue. However, as the side joints are short, the foot is not sufficiently covered, which is detrimental to the quality of the contact between the inside edge of the shell and the inside edge of the foot. Furthermore, the fastening devices are positioned fairly low in these boots.

A third type of boots called "rear entry boots" has recently come onto the market. These have the particularity of possessing a rigid and indeformable shell shaped like a clog. The boot is fastened by means of a wire-operated upper tile-shaped part. This means that the foot is kept away from the shell. This type of boot is not very technical and does not resolve the problems posed.

SUMMARY OF THE INVENTION

It is the purpose of the present invention to provide a remedy to the disadvantages of the Prior Art by proposing a ski boot shell wherein the continuity of the contact between the foot and the shell on the inside edge is optimized and the buckle is positioned higher on the shell so that it does not come into contact with the snow when the skier puts his weight on the edge of the ski in an extreme position.

This ski boot made of plastic material consists of:

- a deformable shell having two tongues which overlap to form flaps over the top of the foot,
- a cuff with a hinge on the shell shaped to form, at the front, two straps forming flaps over the front of the lower part of the leg,
- closing devices intended to slide the flaps over each other and thereby secure the foot in the shell and the lower part of the leg in the cuff, wherein the flap of the shell which corresponds to the outside edge of the foot covers the flap of the inside edge of the foot, whereas the flap which corresponds to the inside edge of the cuff covers the flap of the outside edge of the cuff.

In other words, in a front entry boot, i.e. a boot in which the cuff with a hinge on the shell is formed by two flaps placed on the front which overlap with the inside edge on top of the outside edge, the invention consists of a shell which also has two flaps placed one on top of the other along the top of the foot and which overlap but in this case the outside flap is on top of the inside flap. In this way, the contact of the foot with the inside edge of the shell is increased especially when the skier puts his weight on the edge of the ski in an extreme position and the buckles can be placed higher up on the shell.

In the description and in the claims, the terms "outside edge", "outside" or "outer" are used to described the outside lateral edge of the boot while the terms "inside edge", "inside" and "inner" are used to described the side of the boot designed to be placed opposite the other boot, i.e. the medial side of the boot.

The boot according to the invention is different from front entry boots in that the flaps of the shell are inverted in relation to those of the cuff. It is different from the boot described in DE-A-1 915 442 mentioned in the preamble in that the flaps of the cuff are also inverted in relation to those of the shell. It could not have been imagined that the simple solution provided by the invention, i.e. the inverting of the order in which the flaps of the shell overlap without changing those of the cuff, which represents a breakthrough in relation to the Prior Art, would make it possible to successfully solve a problem which has existed for so long. Now, this difference in architecture results in different functions and considerably improved results.

Preferably, the flap on the inside edge of the boot has a transverse slot located between the fastening area of the forepart of the foot and the fastening area of the instep in order to separate the action of the two fastening devices for easier fitting. Furthermore, this makes it possible to vary the degree of tightness around the veins in the foot, thereby improving comfort.

BRIEF DESCRIPTION OF THE DRAWINGS

The features and advantages of the present invention will be more clearly understood from the following description taken in conjunction with the accompanying drawings.

DESCRIPTION OF THE PREFERRED EMBODIMENTS

Figure 1:
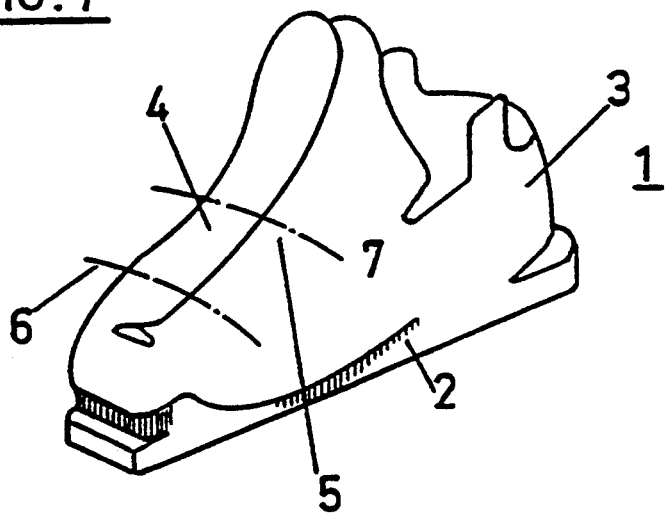
FIG. 1 is a perspective view of a shell of a right ski boot according to the invention.

FIG. 1 shows a shell (1) (right foot) of a ski boot according to the invention. This shell made of semi-rigid plastic consists of a boot sole (2), a heel (3), a flap on the outside (4) and a flap on the inside (5). For reasons of clarity to avoid overcrowding the drawing, only the areas of the fastening devices around the forepart of the foot (6) and the instep (7) are shown. According to a first aspect of the invention, inside flap (5) passes underneath outside flap (4) so as to be continually in contact with the inside edge of the foot or, to be more precise, with the inner boot covering the foot.

Figure 2:
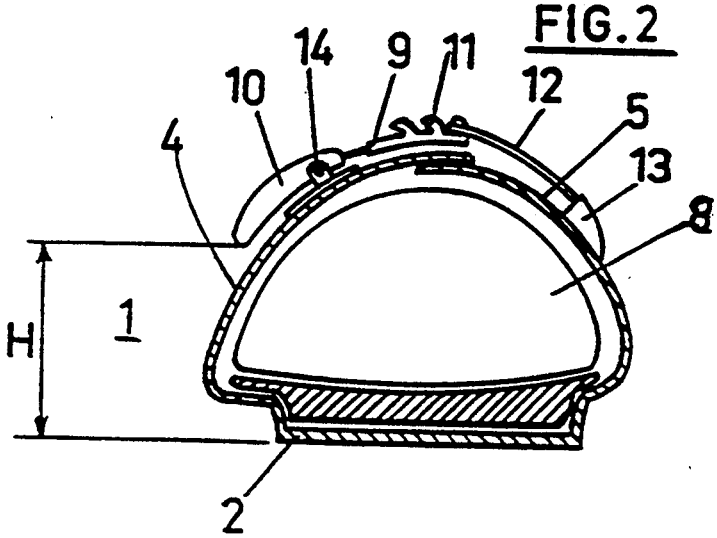
FIG. 2 is a front sectional view of a shell of a right ski boot according to the invention, taken at right angles to the axis of the foot near the start of the metatarses.

FIG. 2 is a cross-section in a plane at right angles to the longitudinal axis of the foot, between areas (6) and (7), the foot being seen from the front. This figure illustrates a shell according to the invention forming two flaps, i.e. a flap on the inside edge of the foot (5) and a flap on the outside edge of the foot (4). Last (8) schematically represents the foot surrounded by the inner boot which provides insulation and comfort.

The action of fastening device (9) consisting, in a known fashion, in order, of a lever (10), attached at (14) on upper outside flap (4), a prong (11) and a buckle (12) attached at (13) on lower inside flap (5), deforms the front of shell (1) so that it comes into contact with last (8). To achieve this, inside flap (5) slides between upper outside flap (4) and inner boot (8) so that, after fastening, inside flap (5) is totally in contact with last (8), in particular with the inside edge of the foot. Therefore, when the skier puts his weight on the edge of the ski, all the inward movements of the foot are passed on in their entirety to the boot and therefore to the ski.

Another advantage of a shell according to the invention is the positioning of fastening device (9) or, to be more precise lever (10). As outside flap (4) is longer than that on "front entry boots", fastening device (9) is positioned on the top of the boot. This means that the end of lever (10) is located at a distance H from the ground which is higher than on conventional boots, preventing it from catching.

Figure 3A:
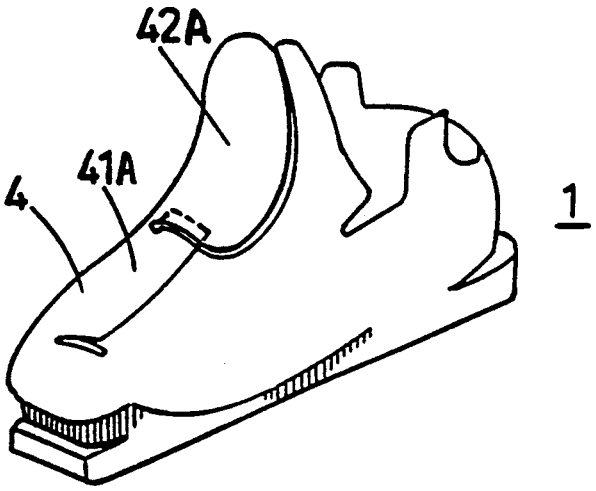
FIGS. 3A and 3B are perspective views of a shell of a right ski boot according to a variation of the invention showing a device designed to facilitate fitting.

FIG. 3A represents a shell of a ski boot according to the invention on which upper outside flap (4) is advantageously cut transversely in order to form two parts, a bottom part (41A) and a top part (42A), with top part (42A) partially covering bottom part (41A). Each part (41A) and (42A) possesses a fastening device (9) allowing the fastening of the forepart of the foot and the instep areas to be adjusted separately by limiting the influence of the fastening of one area on the other. This solution has the advantage, when fitting the boot, of allowing flap (42B) to be opened wide for easier insertion of the foot in the boot.

Figure 3B:
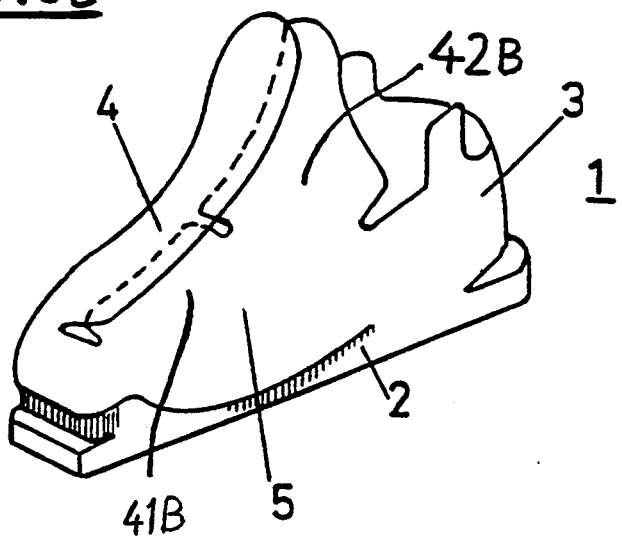

FIG. 3B represents a shell f a ski boot according to the invention on which inside flap (5) is advantageously cut transversely in order to form two parts, a bottom part (41B) and a top part (42B).

Figure 4:
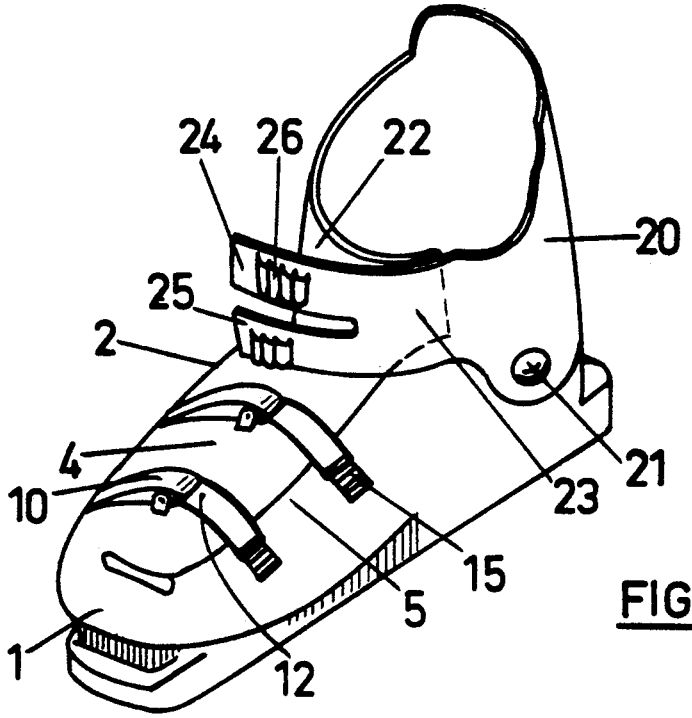
FIG. 4 is a schematic perspective view of a boot according to the invention, shown in a detailed sectional view in FIGS. 5 and 6, respectively a cross-section in a vertical plane through the foot (FIG. 5) and a cross-section in a horizontal plane through the cuff (FIG. 6).
Figure 5:
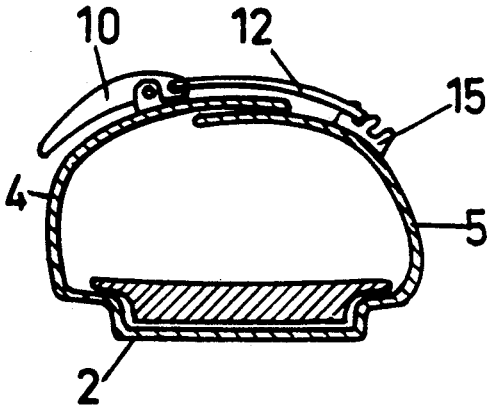
Figure 6:
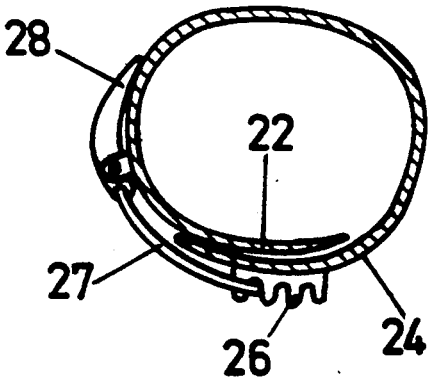

In a second aspect of the present invention, illustrated in FIGS. 4 to 6, the right boot has a conventional cuff (20) with a hinge on shell (1) at (21) near the ankle bones. This semi-rigid plastic cuff (20) forms two straps on the front, an outside strap (22) and an inside strap (23) forming flaps placed on the front of the lower part of the leg. Inside flap (23) is itself formed of two straps (24,25) to which are hooked buckle tooth inserts (26) of the closing device consisting of a buckle (27) operated by a lever (28) placed in a known fashion on outside flap (22). These flaps (22,23) are placed in a conventional fashion, i.e. inside flap (23,24,25) covers outside flap (22).

According to the embodiment shown in FIGS. 4 and 5, lever (10) placed on outside edge (4) is directly associated with buckle (12) which works with a buckle tooth insert (15) provided for this purpose on the top of inside edge (5).

In accordance with the main aspect of the present invention, conventionally, inside flap (23) of cuff (20) covers flap (22) whereas outside flap (4) of the shell covers inside flap (5). The result is that all the levers (10,28) of the closing-fastening devices are placed on the same side, i.e. the outside of the boot. In this way, like with front entry boots, skiing is not hindered.

The particularity of the ski boot according to the invention in comparison with front entry ski boots is the fact that it allows good contact of the shell with the inside edge of the foot leading to great accuracy when the skier puts his weight on the edge of the ski, in particular in extreme positions when pressing on the edge of the ski facing the bend, while ensuring comfort and an even fastening of the foot in the shell.

We claim:

1. Ski boot made of plastic material consisting essentially of:

a deformable shell having two tongues which overlap to form flaps over the top of the foot;

a cuff with a hinge on the shell shaped to form, at the front, two straps forming flaps over the front of the lower part of the leg;

closing device means for sliding the flaps over each other and thereby securing the foot in the shell and the lower part of the leg in the cuff;

wherein the flap of the shell which corresponds to the lateral side of the boot covers the flap of the medial side of the boot, whereas the flap which corresponds to the medial side of the cuff covers the flap of the lateral side of the cuff.

2. Ski boot according to claim 1 wherein the lateral flap of the shell has a transverse slot which divides it into two independent parts comprising first and second flaps.

3. Ski boot according to claim 1 wherein the medial flap of the shell has a transverse slot which divides it into two independent parts comprising a first flap and a second flap.

4. Ski boot according to claim 2 wherein the first flap partially covers the second flap.

5. Ski boot according to claim 3 wherein the first flap partially covers the second flap.

* * * * *